US006425372B1

(12) United States Patent
Hiltner

(10) Patent No.: US 6,425,372 B1
(45) Date of Patent: Jul. 30, 2002

(54) METHOD OF CONTROLLING GENERATION OF NITROGEN OXIDES IN AN INTERNAL COMBUSTION ENGINE

(75) Inventor: Joel D. Hiltner, Powell, OH (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/943,182

(22) Filed: Aug. 30, 2001

(51) Int. Cl.[7] ..... F02M 7/00
(52) U.S. Cl. ..... 123/435; 123/406.41
(58) Field of Search ..... 123/406.41, 435; 60/602; 701/104, 105, 115

(56) References Cited

U.S. PATENT DOCUMENTS

| | | | | | |
|---|---|---|---|---|---|
| 4,063,538 | A | | 12/1977 | Powell et al. | 123/117 R |
| 4,620,438 | A | | 11/1986 | Howng | 73/35 |
| 4,736,724 | A | | 4/1988 | Hamburg et al. | 123/435 |
| 5,038,744 | A | | 8/1991 | Martin et al. | 123/625 |
| 5,050,556 | A | * | 9/1991 | Williams et al. | 123/425 |
| 5,168,854 | A | | 12/1992 | Hashimoto et al. | 123/425 |
| 5,219,227 | A | | 6/1993 | Yang et al. | 374/143 |
| 5,276,625 | A | | 1/1994 | Nakaniwa | 364/431.08 |
| 5,359,883 | A | | 11/1994 | Baldwin et al. | 73/117.3 |
| 5,452,087 | A | | 9/1995 | Taylor et al. | 356/352 |
| 5,560,326 | A | | 10/1996 | Merritt | 123/51 AA |
| 5,592,919 | A | * | 1/1997 | Morikawa | 123/435 |
| 5,714,680 | A | | 2/1998 | Taylor et al. | 73/37 |
| 5,956,948 | A | * | 9/1999 | Nagashima et al. | 60/297 |
| 6,073,440 | A | | 6/2000 | Douta et al. | 60/277 |
| 6,279,537 | B1 | * | 8/2001 | Yonekura et al. | 123/406.48 |

* cited by examiner

*Primary Examiner*—Bibhu Mohanty
(74) *Attorney, Agent, or Firm*—Todd T. Taylor

(57) ABSTRACT

A method of controlling generation of nitrogen oxides in an internal combustion engine is provided with the steps of: combusting a fuel and air mixture within a combustion cylinder; determining a pressure in the combustion cylinder and a position of a piston within the combustion cylinder; calculating an amount of nitrogen oxides generated with the combusting step, dependent upon the determining step; storing a history of the calculated amount of nitrogen oxides in a memory device; and controlling an output action, dependent upon the calculated amount of nitrogen oxides, the stored history of nitrogen oxides and a threshold value of the nitrogen oxides.

16 Claims, 4 Drawing Sheets

METHOD OF CONTROLLING GENERATION OF NITROGEN OXIDES IN AN INTERNAL COMBUSTION ENGINE

TECHNICAL FIELD

The present invention relates to internal combustion engines, and, more particularly, to a method of controlling generation of nitrogen oxides in an internal combustion engine.

BACKGROUND

An internal combustion engine generally is of two basic types, i.e., a spark ignition engine and a compression combustion engine. A spark ignition engine uses a spark plug to ignite the fuel and air mixture which is injected into the combustion chamber. A compression combustion engine utilizes the energy resulting from compression of the fuel and air mixture as the piston travels toward a top dead center position within the combustion cylinder to ignite the fuel and air mixture. Regardless of whether the internal combustion engine is a spark ignition engine or a compression combustion engine, it is desirable to control the point in time at which combustion occurs relative to the position of the piston within the combustion cylinder.

Cycle-to-cycle variations in the combustion event are undesirable characteristics of operating and running a spark ignition engine. The causes of these combustion variations have been attributed to variations in the air/fuel mixture, motion or turbulence (especially in the vicinity of the spark plug), fuel and air charging, and fresh air and residual mixing. The results of these combustion variations are variations in work output or indicated mean effective pressure (IMEP), combustion efficiency, and emissions on a cycle-to-cycle basis (such as nitrogen oxides (NOx)). These combustion variations can manifest themselves in a variety of ways including randomly varying misfires, slow burns, partial burns and fast burns, including detonation or knock. These phenomena are generally more evident under high throttle, high exhaust gas recirculation (EGR), low speed, low turbulence, cold start and lean air/fuel ratio engine operation conditions.

The timing of spark ignition is important in obtaining maximum or desired efficiency and proper operating characteristics of the internal combustion engine. It is also generally understood that the resultant combustion event is a function of ignition and early flame development, and a poor combustion event is known to be primarily a function of those conditions that are present in that individual cycle.

It is known to provide a plurality of pressure sensors which sense pressures within respective combustion cylinders at discrete points in time for the purpose of analyzing a combustion event. Signals from the pressure sensors may be transmitted to an Electronic Control Module (ECM) for the purpose of controlling the timing of the combustion event within the combustion cylinder as the piston reciprocates between a bottom dead center position and a top dead center position. Sensing pressures within combustion cylinders for the purpose of controlling the timing of the engine is disclosed, e.g., in U.S. Pat. Nos. 4,063,538 (Powell et al.), 4,736,724 (Hamburg et al.), 5,276,625 (Nakaniwa), and 5,359,833 (Baldwin et al.). Examples of pressure sensors which withstand the harsh operating environment in a combustion cylinder are disclosed in U.S. Pat. Nos. 5,714,680 (Taylor et al.), 5,452,087 (Taylor et al.), and 5,168,854 (Hashimoto et al.).

The present invention is directed to overcoming one or more of the problems as set forth above.

SUMMARY OF THE INVENTION

In one aspect of the invention, a method of controlling generation of nitrogen oxides in an internal combustion engine is provided with the steps of: combusting a fuel and air mixture within a combustion cylinder; determining a pressure in the combustion cylinder and a position of a piston within the combustion cylinder; calculating an amount of nitrogen oxides generated with the combusting step, dependent upon the determining step; storing a history of the calculated amount of nitrogen oxides in a memory device; and controlling an output action, dependent upon the calculated amount of nitrogen oxides, the stored history of nitrogen oxides and a threshold value of the nitrogen oxides.

DETAILED DESCRIPTION

Figure 1:
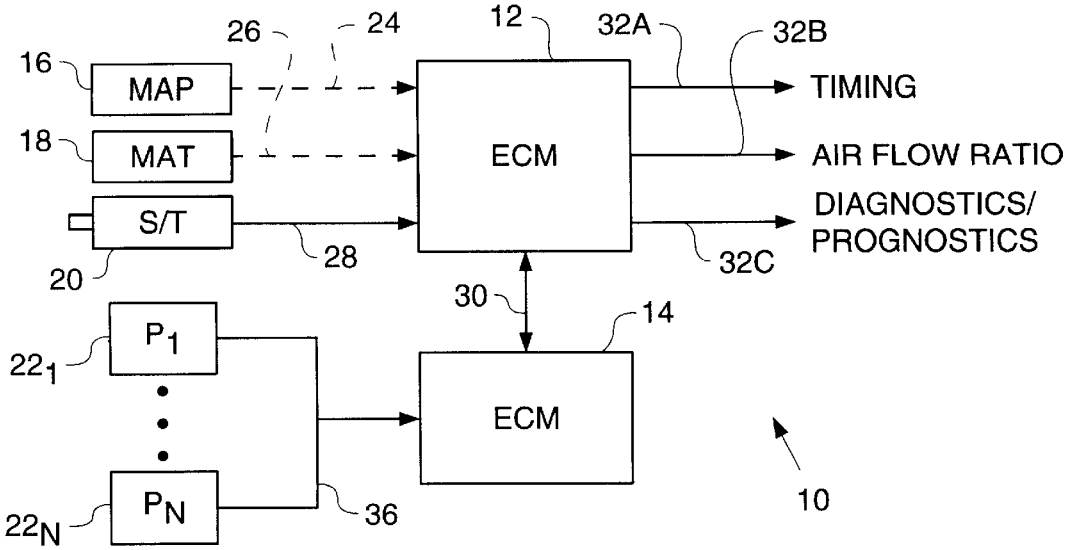
FIG. 1 is a schematic illustration of an embodiment of an internal combustion engine in which a method of controlling generation of nitrogen oxides of the present invention may be carried out.

Referring now to the drawings, and more particularly to FIG. 1, there is shown a schematic view of an embodiment of a spark ignition combustion engine 10 which may be used to carry out a method of the present invention for controlling the generation of NOx. Internal combustion engine 10 generally includes an Electronic Control Module (ECM) 12, an Electronic Control Module (ECM) 14 and sensors 16, 18, 20 and 22.

ECM 12 is a conventional ECM found onboard a vehicle, such as an on-road vehicle, off-road vehicle, etc. ECM 12 includes suitable input/output (IO) circuitry allowing ECM 12 to communicate either unidirectionally and/or bi-directionally with sensors 16, 18 and 20, and ECM 14, as indicated by lines 24, 26, 28 and 30, respectively. In the embodiment shown, lines 24, 26 and 28 transmit data in a unidirectional manner from sensors 16, 18 and 20 to ECM I2. Line 30 communicates data in a bidirectional manner with ECM 14. Output lines 32A, 32B and 32 C are used to effect an action from ECM 12, depending upon the value of the sensed signals. Output line 32A is used to adjust a timing of the combustion within a combustion cylinder 34 (FIG. 2), output line 32B is used to adjust an air flow ratio and output line 32C is used for diagnostics/prognostics.

Sensor 16 is used to sense a manifold air pressure within spark ignition combustion engine 10 and provides a plurality of discrete signals to ECM 12 corresponding to the sensed manifold air pressures. Sensor 18 is used to sense a manifold air temperature and provides a plurality of signals to ECM 12 via line 26. Sensing manifold air pressure and manifold air temperature is optional in the embodiment shown, as indicated by the dashed lines. Sensor 20 is used to sense an engine speed and/or engine coolant temperature and provides a plurality of signals via line 28 to ECM 12. ECM 12 may analyze the values of the signals sensed by sensors 16, 18 and 20 or may pass the data to ECM 14 via line 30.

ECM 14 is used to control the generation of NOx within internal combustion engine 10, and communicates in a bidirectional manner with ECM 12 via line 30. In the embodiment shown, ECM 14 is a separate ECM which is coupled with ECM 12 via line 30. However, it is also to be understood that ECM 14 and ECM 12 may be combined into a common ECM, depending upon the particular application.

Pressure sensors $\mathbf{22}$–$\mathbf{22}_n$ sense pressures within respective combustion cylinders 34 of internal combustion engine 10. The number "n" of pressure sensors 22 corresponds to the number of combustion cylinders within internal combustion engine 10. Sensors $\mathbf{22}_1$–$\mathbf{22}_n$ sense a plurality of pressures at discrete points in time within corresponding combustion cylinders 34 and provide a plurality of pressure signals to ECM 14 via lines 36. In the embodiment shown, lines 36 are assumed to be bus lines such that a common bus is used to communicate with ECM 14. However, it is to be understood that each pressure sensor $\mathbf{22}_1$–$\mathbf{22}_n$ may include a direct connection with ECM 14, depending upon the IO configuration of ECM 14.

Figure 2:
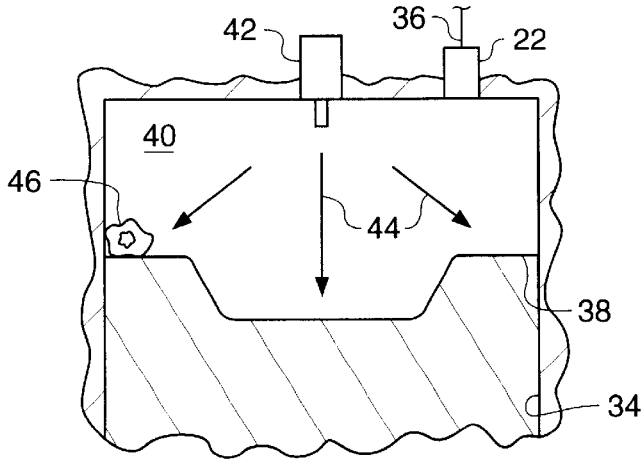
FIG. 2 is a schematic illustration of a combustion cylinder in which a combustion event occurs.

As shown in FIG. 2, each of the plurality of combustion cylinders 34 includes a piston 38 which is slidably disposed therein. Piston 38 may include a contoured crown, as shown, which affects the fluid dynamics of the fuel and air mixture in combustion chamber 40 within combustion cylinder 34. A spark plug 42 ignites the fuel and air mixture in combustion chamber 40 at selected points in time as piston 38 moves between a top dead center position and a bottom dead center position. The combustion propagation proceeds in multiple directions, as indicated by direction arrows 44. Pressure sensor 22 is in fluid communication with combustion chamber 40 and senses a plurality of pressures at discrete points in time. Pressure sensor 22 may be positioned at the axial end of combustion cylinder 34 as shown, or may be positioned at some other desired location (such as a sidewall of combustion cylinder 34), depending upon the particular application.

As shown in FIG. 2, it is possible that not all of the fuel and air mixture combusts during the primary exothermic chemical reaction within combustion chamber 40. Some of the non-combusted fuel which remains within combustion chamber 40 typically may be located in areas within combustion chamber 40 away from spark plug 42, as illustrated by fuel and air mixture pocket 46. It is possible for this fuel and air pocket to combust separately from the primary charge of fuel and air which is injected into combustion chamber 40, thereby causing detonation with an additional shock wave to occur within combustion chamber 40. The uncombusted fuel and air mixture and/or possible detonation (as well as other parameters) affects the combustion event within combustion cylinder 34, which in turn may affect the generation of NOx.

Figure 3:
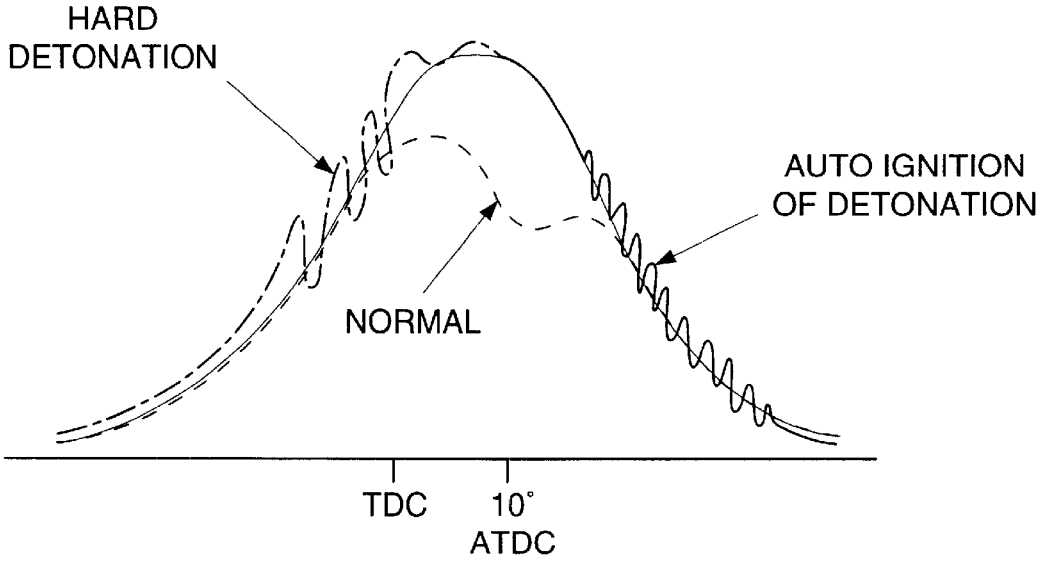
FIG. 3 is a graphical illustration of an occurrence of detonation with respect to a pressure profile curve of a combustion cylinder within an internal combustion engine.

Referring to FIG. 3, a pressure profile curve is shown with the piston position being represented on the horizontal axis and the pressure within the combustion chamber being represented on the vertical axis. During normal operation (indicated by the dashed line), the pressure within combustion cylinder 34 reaches a maximum near or shortly after a top dead center position of the piston 38 within combustion cylinder 34. Typically, detonation does not occur during normal operation.

It is also possible for the peak pressure to be magnified at a point in time which is delayed relative to the top dead center position of piston 38. Detonation of fuel and air pocket 46 within combustion chamber 40 may occur along the pressure profile curve at a point in time after the peak pressure, which is referred to as "auto ignition of detonation" in FIG. 3. This type of detonation is evidenced by higher frequency vibrations of the pressure changing from a plus to a minus value as the pressure fluctuates. This type of detonation occurring after the peak pressure has been found not to be particularly deleterious to operation of spark ignition combustion engine 10.

On the other hand, detonation of fuel and air pocket 46 which occurs before the peak pressure, referred to as "hard detonation", has been found to be deleterious to operation of compression combustion engine 10. If hard detonation is sensed, it is possible to take various actions which either eliminate the detonation or move the detonation to a point in time after occurrence of the peak pressure such that the detonation is not harmful. For example, it is possible to adjust the timing of the ignition event; reduce an amount of fuel which is injected into combustion engine 10; and/or reduce a load on spark ignition combustion engine 10 to affect the location of the detonation on the pressure profile curve shown in FIG. 3.

Combustion events as described above in combustion chamber 40 within combustion cylinder 34 affects the combustion efficiency and operation of internal combustion engine 10. The combustion efficiency in turn affects the generation of NOx emitted from internal combustion engine 10. It is possible to calculate the amount of NOx which is emitted from internal combustion engine 10 using various input parameters. The input parameters are then used to calculate the heat release during the combustion event as well as the burn temperature of the fuel and air mixture during the combustion event.

Figure 4:
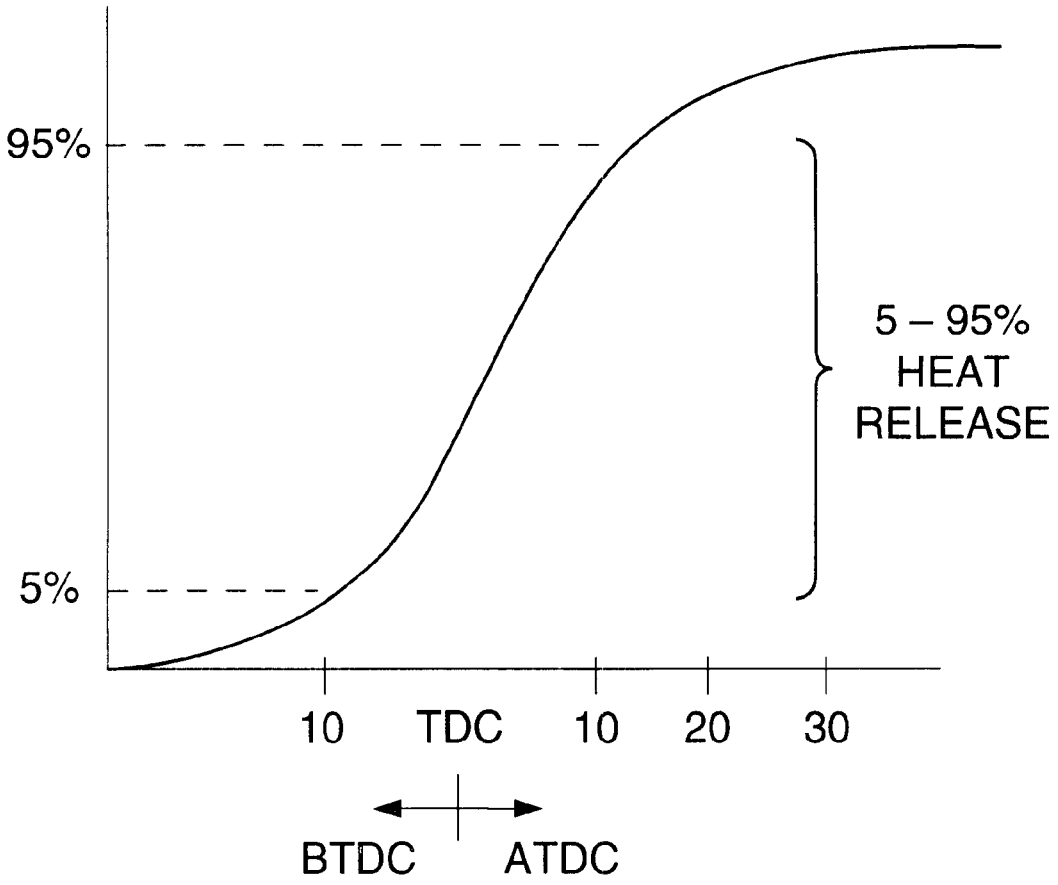
FIG. 4 is a graphical illustration of the heat release within a combustion cylinder, relative to the position of the piston within the combustion cylinder.

Referring now to FIG. 4, it may be observed that a large percentage of the heat release associated with a combustion event occurs while the piston is near a top dead center position. More particularly, a large percentage of the heat release for a given combustion event occurs when the piston moves through a position approximately 10° before top dead center to a position approximately 10° after top dead center.

Industrial Applicability

Figure 5:
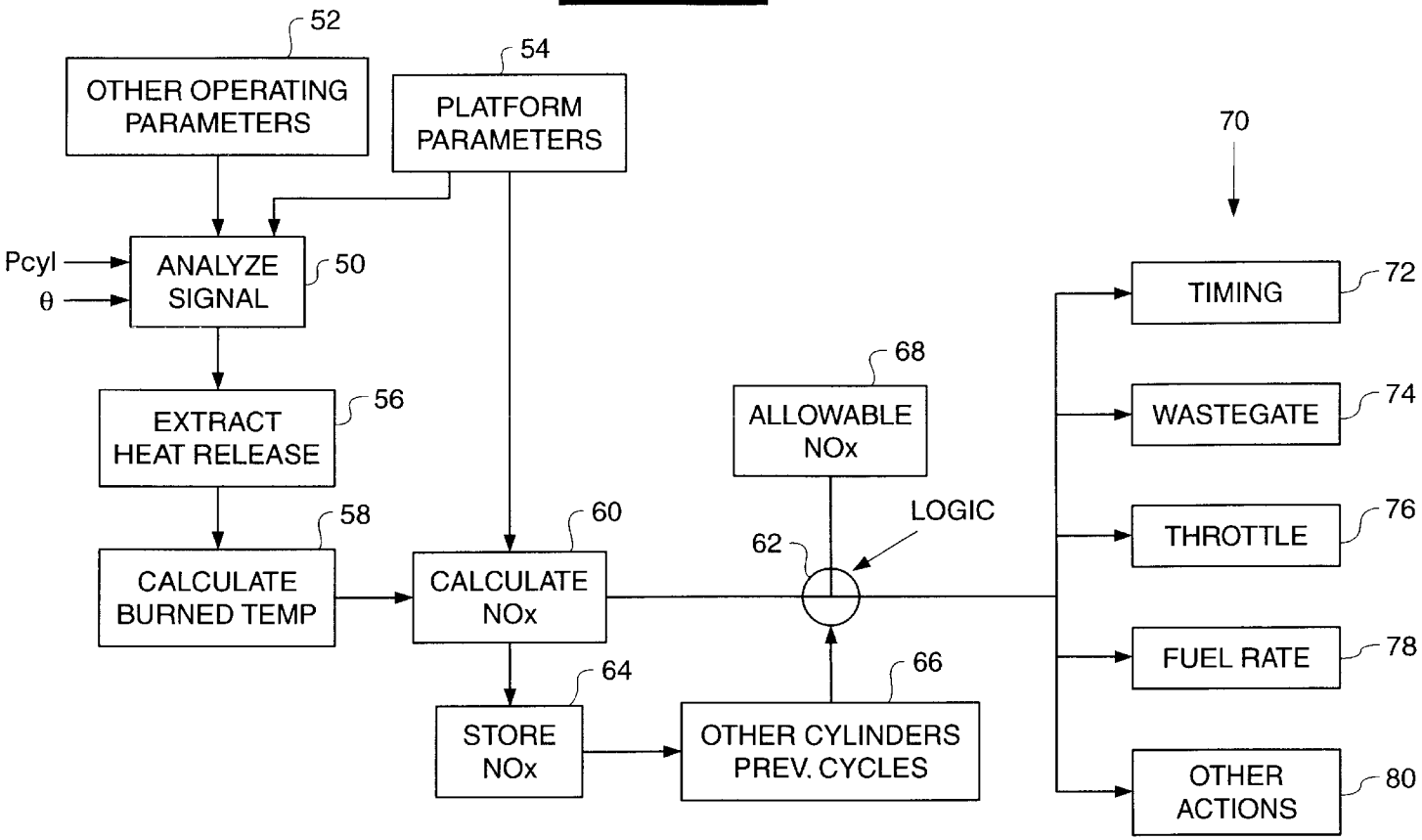
FIG. 5 is a block diagram of one embodiment of a method of the present invention which may be utilized with the internal combustion engine of FIG. 1.

Referring now to FIG. 5, there is shown a block diagram of an embodiment of the method of the present invention for controlling the generation of NOx in internal combustion engine 10. At block 50, various input parameters are received and analyzed. To wit, the pressure (Pcyl) corresponding to one or more combustion cylinders sensed by a pressure sensor 22 is received. In addition, the crank angle θ of a crank shaft carrying the plurality of pistons 38 is received. The crank angle θ in turn is used to determine the position of the piston 38 within the combustion cylinder 34 for which the sensed pressure corresponds. Other operating parameters (block 52) such as manifold air pressure, manifold air temperature, etc. may also be sensed within internal combustion engine 10 and used at block 50. Additionally, engine platform parameters (block 54) specific to a particular engine may be sensed within internal combustion engine 10 and provided for analysis at block 50.

At block 56, the various signals analyzed at block 50 are used to extract the heat release corresponding to the combustion event within combustion chamber 40. The input parameters may be used in an individual or combined manner to calculate the heat release for the combustion event. Extracting the heat release of the combustion event using mathematical techniques is known in the art, and thus will not be described in further detail herein (see, e.g., U.S. Pat. No. 5,219,227, column 7). Based upon the calculated heat release, the burned temperature of the fuel and air mixture for the combustion event is then calculated (block 58). Again, calculating the burned temperature of a fuel and air mixture for a combustion event is known and thus not described in further detail herein.

At block 60, the amount of NOx which is generated for the combustion event is calculated using the burned temperature from block 58 and (optionally) platform parameters from block 54. The calculated NOx is then utilized within logic circuit 62 and a memory device. The calculated NOx is stored individually within the memory device (block 64) and/or mathematically combined with the calculated NOx for other cylinders from previous cycles (block 66). The individually stored NOx amounts and/or the combined NOx amounts from previous cycles are utilized by logic circuit 62. Additionally, logic circuit 62 receives a threshold value corresponding to allowable NOx which may be generated by internal combustion engine 10. The calculated amount of NOx from block 60, stored history of NOx from block 66 and threshold value of allowable NOx (block 68) are analyzed with logic circuit 62 to determine whether an output action 70 should occur. More particularly, the calculated NOx, stored history of NOx and threshold value of NOx are mathematically combined within logic circuit 62 to determine whether an output action 70 should occur. Output actions 70 may include, e.g., adjusting the timing (block 72), waste gate (block 74), throttle (block 76), fuel rate (block 78) and/or other appropriate actions (block 80).

From the foregoing description of an embodiment of the method of the present invention, it is apparent that logic circuit 62 receives multiple inputs corresponding to the NOx generated by internal combustion engine. By basing an output action 70 upon multiple inputs, including the calculated NOx, stored history of NOx and allowable threshold value of NOx, a more accurate determination of whether to take an output action 70 is effected. The output action may include any number of output actions as shown, or may include no action. The method of the present invention therefore provides improved control over the generation of NOx within internal combustion engine 10.

Other aspects, objects and advantages of this invention can be obtained from a study of the drawings, the disclosure and the appended claims.

What is claimed is:

1. A method of controlling generation of nitrogen oxides in an internal combustion engine, comprising the steps of:

combusting a fuel and air mixture within a combustion cylinder;

determining a pressure in said combustion cylinder and a position of a piston within said combustion cylinder;

calculating an amount of nitrogen oxides generated with said combusting step, dependent upon said determining step;

storing a history of said calculated amount of nitrogen oxides in a memory device; and controlling an output action, dependent upon said calculated amount of nitrogen oxides, said stored history of nitrogen oxides and a threshold value of said nitrogen oxides.

2. The method of claim 1, said controlling step including controlling at least one of: a timing; a wastegate; a throttle; a fuel rate; and another action affecting said generated nitrogen oxides.

3. The method of claim 1, said calculating step including calculating a heat release and a burned temperature of said fuel and air mixture.

4. The method of claim 1, including the step of providing other operating parameters associated with said generated nitrogen oxides, said calculating step being dependent upon said other operating parameters.

5. The method of claim 1, including the step of providing engine platform parameters associated with said generated nitrogen oxides, said calculating step being dependent upon said engine platform parameters.

6. The method of claim 1, said internal combustion engine being a multi-cylinder internal combustion engine; said combusting, determining, calculating and storing steps being carried out for each of said cylinders.

7. The method of claim 6, said storing step including storing a combined history of said calculated amount of nitrogen oxides for each of said cylinders.

8. The method of claim 6, said multi-cylinder internal combustion engine including a crankshaft, and said determining step including determining said position of said piston based upon a position of said crankshaft.

9. The method of claim 1, said step of determining said pressure in said combustion cylinder being carried out using a pressure sensor positioned in communication with said combustion cylinder.

10. A method of controlling generation of nitrogen oxides in a multi-cylinder internal combustion engine, comprising the steps of:

combusting a fuel and air mixture within a plurality of combustion cylinders in the multi-cylinder internal combustion engine;

determining a pressure in each of said combustion cylinders and a position of a plurality of corresponding pistons;

calculating an amount of nitrogen oxides generated with said combusting step, dependent upon said determining step;

storing a combined history of said calculated amount of nitrogen oxides for each of said cylinders in a memory device; and controlling an output action, dependent upon said calculated amount of nitrogen oxides, said stored history of nitrogen oxides and a threshold value of said nitrogen oxides.

11. The method of claim 10, said controlling step including controlling at least one of: a timing; a wastegate; a throttle; a fuel rate; and another action affecting said generated nitrogen oxides.

12. The method of claim 10, said calculating step including calculating a heat release and a burned temperature of said fuel and air mixture for each of said cylinders.

13. The method of claim 10, including the step of providing other operating parameters associated with said generated nitrogen oxides, said calculating step being dependent upon said other operating parameters.

14. The method of claim 10, including the step of providing engine platform parameters associated with said generated nitrogen oxides, said calculating step being dependent upon said engine platform parameters.

15. The method of claim 10, said multi-cylinder internal combustion engine including a crankshaft, and said determining step including determining said position of each said piston based upon a position of said crankshaft.

16. The method of claim 10, said step of determining said pressure in each said cylinder being carried out using a plurality of pressure sensors, each said pressure sensor being positioned in communication with a corresponding said cylinder.

* * * * *